United States Patent [19]

Koddenberg et al.

[11] Patent Number: 4,564,421

[45] Date of Patent: Jan. 14, 1986

[54] ASCENSION PIPE FOR COKE OVENS

[75] Inventors: Theo Koddenberg, Bochum; Franz-Josef Hegemann, Castrop-Rauxel, both of Fed. Rep. of Germany

[73] Assignee: Dr. C. Otto & Comp. GmbH, Bochum, Fed. Rep. of Germany

[21] Appl. No.: 380,548

[22] Filed: May 21, 1982

[30] Foreign Application Priority Data

Jun. 20, 1981 [DE] Fed. Rep. of Germany ..... 3124356

[51] Int. Cl.[4] ..... C10B 27/00

[52] U.S. Cl. ..... 202/254; 202/267 R; 202/DIG. 1

[58] Field of Search ..... 202/254–256, 202/259, 267 R, DIG. 1

[56] References Cited

U.S. PATENT DOCUMENTS

| | | | |
|---|---|---|---|
| 1,700,971 | 2/1929 | Becker | 202/256 |
| 1,800,717 | 4/1931 | Cole | 202/254 |
| 2,753,893 | 7/1956 | Brown | 202/255 |
| 3,309,286 | 3/1967 | Alderman | 202/254 |

FOREIGN PATENT DOCUMENTS

| | | | |
|---|---|---|---|
| 533322 | 11/1956 | Canada | 202/254 |
| 319888 | 4/1920 | Fed. Rep. of Germany | 202/254 |

*Primary Examiner*—Peter Kratz

*Attorney, Agent, or Firm*—Thomas H. Murray; Clifford A. Poff

[57] ABSTRACT

An ascension pipe for coke oven installations wherein the inner periphery of the pipe is lined with refractory brick and wherein a tube of heat-resistant steel covers the inner periphery of the brick lining. Only minor deposits form on this tube during operation of the coke oven. These deposits can be removed easily by vertically-guided scrapers without damaging the refractory, in contrast to prior art ascension pipes wherein the deposits must be removed from the refractory bricks themselves.

5 Claims, 2 Drawing Figures

ASCENSION PIPE FOR COKE OVENS

BACKGROUND OF THE INVENTION

As is known, coke ovens may be equipped with one or more offtakes to carry away the volatile products liberated in the coking process. The volatile products pass through a duct in the top of the oven and enter a refractory-lined standpipe, usually called an "ascension pipe", which is connected through a supply pipe to a gas-collecting main. The inner periphery of the ascension pipe is lined with refractory bricks or some other type of refractory material. Steam and water are commonly injected into the supply pipe or the ascension pipe itself to clean the issuing gases prior to the time that they enter the gas-collecting main.

The ascending gases in an ascension pipe of this sort often form carbonaceous deposits on the inner wall of the refractory lining. The deposits must be periodically removed either by attempting to burn them from the refractory walls or with the use of scrapers which are lowered on chains into the ascension pipe and repeatedly moved up and down within the pipe to remove deposits from the refractory walls. The use of these mechanical devices, however, may destroy part of the refractory lining; whereas burning of deposits pollutes the environment. As will be understood, deposits of this type on the inner lining of ascension pipes are highly undesirable and impede the operation of the coke oven.

SUMMARY OF THE INVENTION

In accordance with the present invention, means are provided to prevent the aforementioned deposits from forming on the inner periphery of an ascension pipe or, if they are formed, to facilitate their removal in a very simple manner without damaging the refractory lining.

In carrying forth the invention, the inner periphery of the refractory lining of the ascension pipe is covered by a tube of heat-resistant metal, preferably steel. Since the temperature of the gases withdrawn through the ascension pipe is usually not above 700° C., suitable materials are available for such tubes. The tubes have a flange at the top edge thereof which extends over and covers the refractory lining and acts to support the lining within the ascension pipe. If the outer shell of the ascension pipe comprises a number of sections interconnected by flanges, the heat-resistant steel tube is similarly divided, in which case the individual portions of the inserted inner tube will also have top flanges which are used to secure the steel tubes to the lining.

It has been found that only slight deposits form on the aforementioned steel tube or tubes which have a smooth surface. If such deposits do occur, they can be removed easily by vertically-guided scrapers without the risk of damaging the refractory lining.

Figure 1:
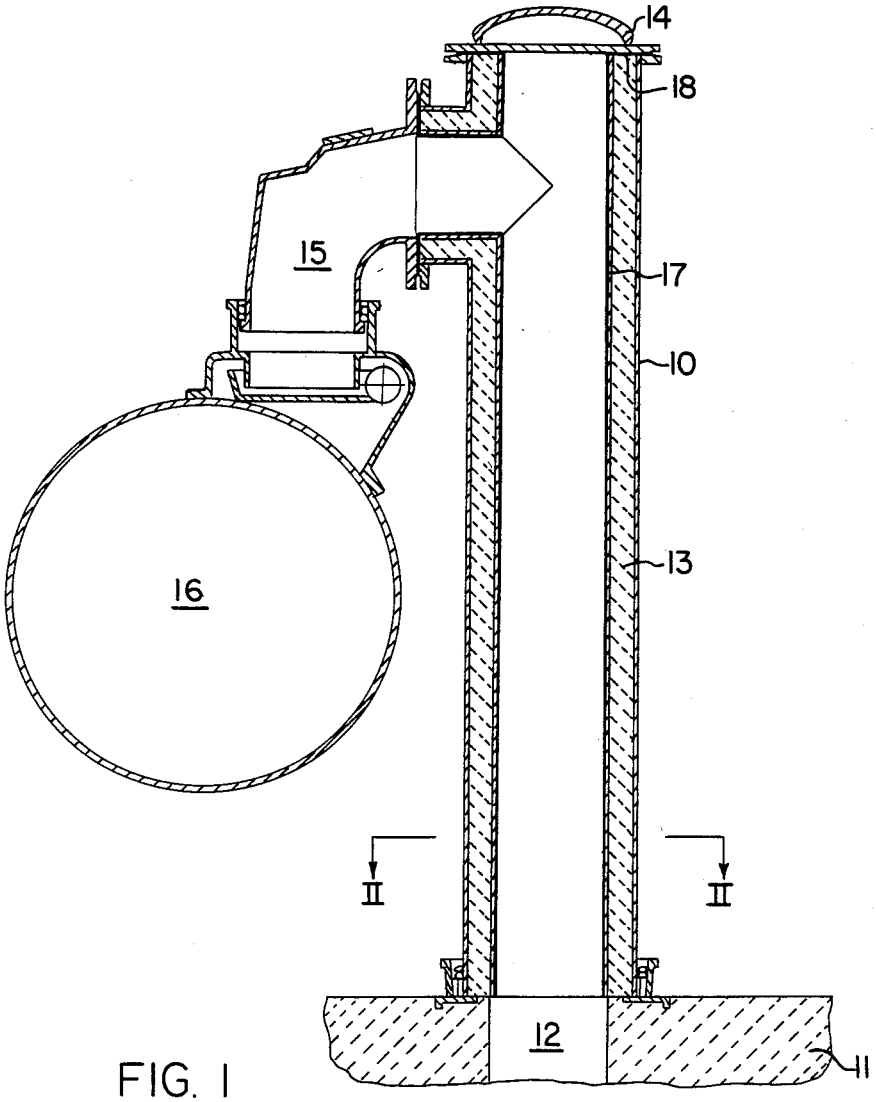
Figure 2:
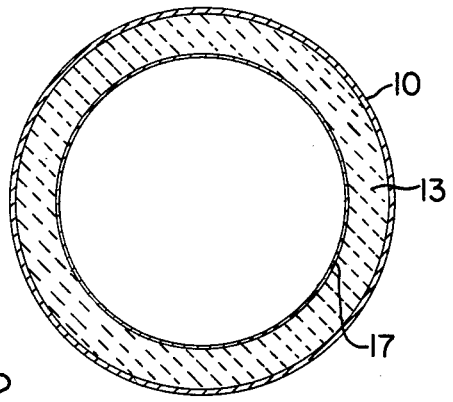

The above and other objects and features of the invention will become apparent from the following detailed description taken in connection with the accompanying drawings which form a part of this specification, and in which:

FIG. 1 is a vertical sectional view through an ascension pipe disposed on a coke oven roof, showing its connection to a gas main; and FIG. 2 is a cross-sectional view of the ascension pipe of FIG. 1 taken substantially along line II—II of FIG. 1.

With reference now to the drawings, the ascension pipe is designated generally by the reference numeral 10 and is provided at its upper end with a dome-shaped cover 14 which can be removed when necessary to clean the inner periphery of the pipe. The ascension pipe is positioned over an opening 12 in a coke oven roof 11, the products of combustion in the coking process passing upwardly through the opening 12 and into the ascension pipe.

The ascension pipe 10 comprises an outer steel shell having on its inner periphery a refractory lining 13 which may comprise refractory bricks or a rammed refractory material. In accordance with the present invention, a heat-resistant steel tube 17 is disposed on the inner periphery of the refractory lining 13, the tube having a top flange 18 which extends over the refractory lining 13. Gases passing upwardly through the opening 12 and ascension pipe 10 then pass through an elbow or bend 15 and into a collecting main 16 which is also connected by similar ascension pipes to other ovens in the coke oven battery.

By virtue of the fact that the inner periphery of the refractory lining 13 is lined with the heat-resistant steel tube 17, the tendency to collect deposits on the inner periphery of the tube 17 is less than it is when the refractory lining 13 is exposed to the ascending gases. At the same time, if deposits are formed on the inner periphery of the tube 17, they may be much more readily removed than in the case where they form directly on the inner periphery of the refractory lining 13.

Although the invention has been shown and described in connection with a certain specific embodiment, it will be readily apparent to those skilled in the art that various changes in form and arrangement of parts may be made to suit requirements without departing from the spirit and scope of the invention.

We claim as our invention:

1. An ascension pipe for coke ovens comprising an outer shell, a refractory lining on the inner periphery of the outer shell, and a tube of heat-resistant metal on the inner periphery of the refractory lining, whereby the formation of deposits on the tube during operation of a coke oven will be minimized, which deposits can be removed readily by vertically-guided scrapers without risk of damaging the lining.

2. The ascension pipe of claim 1 wherein said refractory lining is formed from brick.

3. The ascension pipe of claim 1 wherein said refractory lining is formed from a ramming compound.

4. The ascension pipe of claim 1 wherein said heat-resistant metal comprises steel.

5. The ascension pipe of claim 1 wherein said tube of heat-resistant material is provided with a radially-extending top flange which overlies said refractory lining.

* * * * *